United States Patent [19]

Gorling

[11] 3,955,960

[45] May 11, 1976

[54] METHOD FOR ROASTING FINELY DIVIDED SULPHIDE MATERIAL CONSISTING OF MAGNETIC PYRITES OR OF A FINELY DIVIDED MATERIAL DERIVED FROM A PYRITIC MATERIAL, IN WHICH THERMALLY SPLITTABLE SULPHUR IS EXPELLED BY PARTIAL ROASTING OR OTHER THERMAL TREATMENT

[75] Inventor: Karl Goran Gorling, Lidingo, Sweden

[73] Assignee: Boliden Aktiebolag, Stockholm, Sweden

[22] Filed: July 22, 1974

[21] Appl. No.: 490,749

Related U.S. Application Data

[63] Continuation of Ser. No. 331,606, Feb. 12, 1973, abandoned, which is a continuation of Ser. No. 135,134, April 19, 1971, abandoned.

[30] Foreign Application Priority Data

Apr. 20, 1970 Sweden ..... 5393/70

[52] U.S. Cl. ..... 75/3; 75/9; 75/21; 75/26

[51] Int. Cl.[2] ..... C22B 1/08; C22B 1/10

[58] Field of Search ..... 75/1, 3, 21, 23, 26

[56] References Cited

UNITED STATES PATENTS

| | | | |
|---|---|---|---|
| 3,094,409 | 6/1963 | Renzoni | 75/9 |
| 3,649,245 | 3/1972 | Colombo | 75/9 |
| 3,681,046 | 8/1972 | Bryk | 75/26 |
| 3,856,506 | 12/1974 | Fahlstrom | 75/9 |

*Primary Examiner*—Peter D. Rosenberg
*Attorney, Agent, or Firm*—Stevens, Davis, Miller & Mosher

[57] ABSTRACT

A method for roasting finely divided iron sulphide material in a manner to obtain a coarse, substantially sulphur-free product, the sulphide material consisting of pyrrhotite or a finely divided materal derived from a pyritic material in which thermally splittable sulphur has been driven off by partial roasting for example. According to the method, the sulphide material is first agglomerated to a particle size distribution suitable for fluidizing purposes and then roasted and hardened in a fluidized bed, whereafter the material is removed from the bed in a hot state.

8 Claims, 2 Drawing Figures

Figure 1:
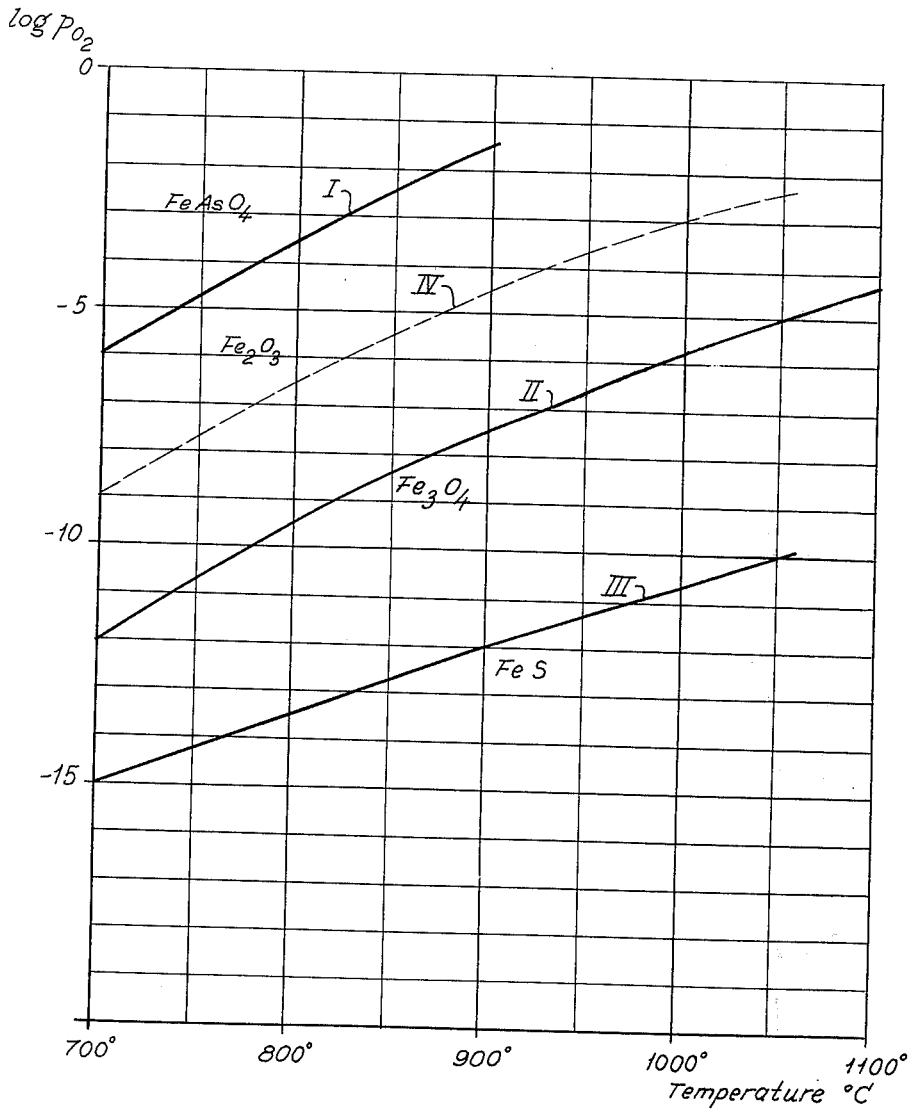

METHOD FOR ROASTING FINELY DIVIDED SULPHIDE MATERIAL CONSISTING OF MAGNETIC PYRITES OR OF A FINELY DIVIDED MATERIAL DERIVED FROM A PYRITIC MATERIAL, IN WHICH THERMALLY SPLITTABLE SULPHUR IS EXPELLED BY PARTIAL ROASTING OR OTHER THERMAL TREATMENT

This is a continuation of application Ser. No. 331,606, filed Feb. 12, 1973, which is a continuation of Ser. No. 135,134 filed Apr. 19, 1971.

The present invention relates to a method for roasting finely divided sulphide material in a manner to obtain a coarse, substantially sulphur free product, the sulphide material comprising pyrrhotite or a finely divided material derived from a pyritic material, in which thermally slittable sulphur is driven off by partial roasting or some other thermal treatment process.

Certain raw materials which are to undergo metallurgical treatment possess unsatisfactory physical properties. These materials are often in fine powder form and have a low degree of denseness and as a result thereof are highly dust forming. Moreover, such materials are liable to absorb water when moistened. Such properties render the material less suitable for handling, storage, transportation and further metallurgical treatment, such as pan sintering or sintering in conveyortype furnaces, or treatment in rotary furnaces, shaft furnaces or electric smelting furnaces. These materials are also often too fine for use with fluidizing processes, in which large quantities of gaseous fluidizing medium are charged to the system.

A particularly serious and difficult problem is one concerned with the handling, storing, transporting and processing of materials obtained from the roasting of fine metal sulphides, particularly flotation concentrates, which concentrates are finely ground before being enriched, in order to facilitate selective isolation of the different minerals contained therein. Similar problems exist when treating roasted products derived from coarser sulphide materials which have been decrepitated during the roasting process.

THE PRIOR ART

Various methods have been proposed and tested for producing coarse powder, roasted products from finely divided material, of which methods pelletizing and briquetting can be mentioned in particular. These methods involve firstly agglomerating the material in the absence of heat and in the presence of water and possibly also a binding composition, whereafter the material is normally dried and burned at elevated temperatures. Attempts have also been made to briquette iron oxide raw materials at elevated temperatures (800°–1100°C). These experiments, however, have not lead to processes which can be used industrially, not only because it is both technically difficult and expensive to heat extremely fine material but mainly because it has been impossible to find a sufficiently strong material for the briquette molds.

GENERAL DESCRIPTION OF THE INVENTION

The present invention relates to a method for roasting finely divided sulphide material in a manner whereby a coarse, substantially sulphur free product is obtained, the sulphide material comprising pyrrhotite or a finely divided material derived from a pyritic material, in which thermally splittable sulphur is expelled by partial roasting or some other thermal treatment process, characterized in that the sulphide material is first agglomerated, for example by rolling, micropelletizing or some other granulating method, and given a particle size distribution suitable for fluidizing purposes, and that the agglomerated material is roasted and simultaneously hardened in a fluidized bed furnace, from the bed of which the material can be removed in a hot condition. It is suitable in conjunction therewith that any fine material entrained with the roaster gases is separated therefrom and passed back to the agglomerating stage.

In Swedish Pat. No. 319,500 there is described a method for roasting finely divided sulphur-containing concentrates in a fluidized bed furnace, the material being given by rolling sufficient mechanical strength and a large enough particle size to prevent it from being entrained with the gases before roasting is substantially completed. This method primarily relates to the treatment of finely divided pyrites. The product is also obtained in a finely divided form. It has now been surprisingly discovered that if a material comprising pyrrhotite or a finely divided material derived from pyritic material from which thermally splittable sulphur has been driven off by partial roasting or some other thermal treatment process is roasted and hardened in accordance with the present invention, agglomerates can be produced which can be retained in the bed for long periods of time and which can be removed from the bed in a coarse powder form.

The iron sulphide material is suitably agglomerated by rolling between smooth or surface knurled rolls. The requisite roll pressure is primarily determined by the diameter of the rolls but is also affected by other factors, such as the properties of the material, temperature and possible additions of substances which act as binding agents. A sufficiently strong agglomerate can usually be obtained at a roll pressure of between 1 and 10 tons per cm roll length, although in certain instances still lower pressures can be used.

As an example of material in which thermally splittable sulphur has been driven of by partial roasting can be mentioned material partly rotated in accordance with the German Pat. Nos. 1,024,493 and 1,043,295. These patents describe methods in which, for example, pyritic materials are partially roasted in a first stage in a manner whereby the resultant intermediate product comprises substantially iron (II) sulphide and iron (II, III) oxide, whereafter the product is completely roasted in a second stage. The intermediate product can suitably be agglomerated and finally roasted in accordance with the present invention.

It is thus possible according to the present invention when roasting the finely divided sulphide material to produce a coarse powder product which can be removed from the bed substantially free from finely divided material. The particle sizes of the agglomerates should be adjusted by selection of suitable agglomerating methods or by screening so that the screen curve of the material is suitable for fluidizing purposes. The particle size of the agglomerates should normally not exceed roughly 8 mm. A material showing a steep screen curve, i.e. where the majority of the particles have the same size, is much less suited for fluidizing than a material having a flatter screen curve.

During the roasting process, the material is windsifted and the material which has not been given a sufficiently high particle size during the agglomerating stage can be removed from the gases departing from the roasting furnace in a gas purification system. Material separated in this system is suitably returned to the process by being mixed with the incoming sulphide material. It has been found to advantage to mix sulphide material with the finely divided separated roasted products while these are still hot. This dries the sulphide material, thereby facilitating handling and agglomerating thereof. The moisture content of the agglomerates when entering the hot fluidized bed should not be so great than the agglomerates disintegrate under the pressure of the steam thus generated. Depending on the load on the roast, the quantity of roasted products entrained by the gases leaving the furnace may vary between 10% and 50% of the total quantity of roasted products, normally between 10% and 25%.

The method of the present invention solves a number of problems connected with the roasting of finely grained sulphide material of the aforementioned type. One of the main advantages afforded by the invention is that a non-dusty agglomerated iron oxide material is obtained, which requires no wetting before being transported. Because of its coarse powder structure, the material is well suited for suction sintering or further treatment in, for example, rotary furnaces, multihearth furnaces or shaft furnaces. The material is, of course, especially suited for treatment in fluidized beds. A further advantage afforded by the invention is that the material can be removed from the furnace in a hot condition and be further treated in other thermal processes without requiring additional heating. It has been found that a coarse roasted product obtained in accordance with the present invention can be used to advantage in chlorinating volatilization process, for example in accordance with Swedish Pat. No. 319,785 or the East German Pat. No. 70,609, oxidic iron material containing one or more of the substances Cu, Zn, Pb, Co, Ni, Au, Ag, As, Bi, Sb, and S in a hot condition, for example between 600° and 1100°C, being treated with a gas containing chlorine or chlorine compounds or with a material which gives off a gas containing chlorine or chlorine compound, whereby the said substances are volatilized. The chlorination process can be carried out in different types of furnaces. Fluidized bed furnaces or furnaces having mobile beds have been found particularly suitable for this purpose.

By practicing the method of the present invention, it is possible to effect roasting at a considerably high load on the roasting area and furnace volume than when roasting a non-agglomerated material. Because the agglomerates are retained in the bed over a period of time which is many times greater than that obtained with conventional roasting of finely divided material, sulphur is roasted off more completely with the method of the present invention.

It is of particularly advantage to effect a magnetite yielding roasting process in connection with the described method. A roasting process of this type is described in the Swedish Pat. No. 204,002. The method can also be combined to advantage with the processes described in the Canadian Pat. No. 796,672. According to this patent, iron sulphide material for example is roasted in a fluidized bed furnace at temperatures between 700° and 1100°C, while gas containing free oxygen is supplied in such quantities that the partial pressure of oxygen in the resulting roaster gases is maintained beneath a pressure temperature curve (II in FIG. 1) which in a coordinate system, where the ordinate expresses the oxygen partial pressure in the atmosphere as $\log_{10}P_{O_2}$ and the abscissa the temperature in °C is drawn through the following points:

| $\log_{10}P_{O_2}$ | Temp. |
|---|---|
| −12.0 | 700 |
| − 9.5 | 800 |
| − 7.5 | 900 |
| − 5.8 | 1000 |
| − 5.0 | 1050 |

but not beneath a corresponding curve (III) through the following points:

| $\log_{10}P_{O_2}$ | Temp. |
|---|---|
| −15.0 | 700 |
| −13.5 | 800 |
| −12.0 | 900 |
| −10.7 | 1000 |
| −10.0 | 1050 |

whereby the material is freed from sulphur and sulphur compounds, so that substantially sulphur free cinders are obtained. Any arsenic, antimony, bismuth, tin and lead present in the material is driven off during the roasting process. When roasting within the described region, agglomerates of particularly high mechanical strength are obtained and less finely divided dust is entrained with the roaster gases.

According to said Canadian patent specification, when roasting arsenic containing iron sulphide material arsenic can be driven off at slightly higher oxygen partial pressures. This is obtained under an analogously drawn pressure temperature curve (I) passing through the following points:

| $\log_{10}P_{O_2}$ | Temp. |
|---|---|
| −6.0 | 700 |
| −3.0 | 800 |
| −1.5 | 900 |

whereby secondary reactions between arsenic and its compounds and the roasted products is counteracted and the latter is obtained substantially free from sulphur and arsenic.

According to an embodiment preferred in practice, the partial pressure of oxygen in the last mentioned instance is maintained beneath a pressure temperature curve (IV) passing through the following points:

| $\log_{10}P_{O_2}$ | Temp. |
|---|---|
| −9.0 | 700 |
| 6.5 | 800 |
| −4.5 | 900 |
| −3.0 | 1000 |
| −2.3 | 1050 |

In the case of roasting finely divided iron sulphide material in order to expel arsenic therefrom it has hitherto been necessary to separate the roasted products entrained with the roaster gases from the gas phase at a temperature of such magnitude that no condensation of arsenic and sulphur compounds or re-formation of arsenates take place when the gas is cooled or in connection with possible subsequent after-burning stages. Since, with the method of the present invention, all roasted products are removed from the bed, where suitable temperature and furnace atmospheres can be adjusted without difficulty, it is not necessary to separate the finely roasted products entrained with the roasted gases at high temperatures and neither is it necessary to use hot cyclones, which are expensive to manufacture and maintain. The roasting process can thus be effected, with slight modifications, in the same type of BASF-furnace as that used with conventional oxidation roasting processes.

Finely divided iron oxide material can be agglomerated together with the sulphidic material to be roasted off.

Figure 2:
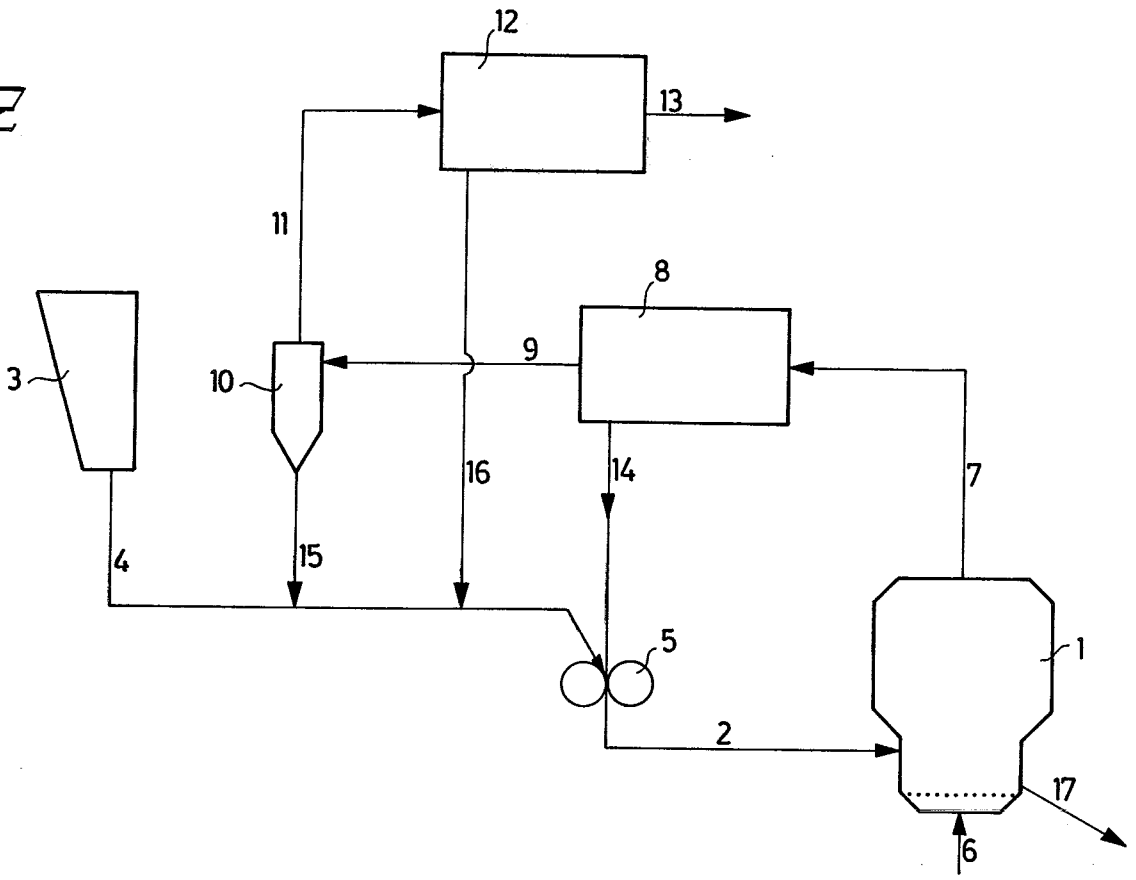

In the drawings, FIG. 1 shows a pressure-temperature diagram with the aforementioned curves I–IV written in, while FIG. 2 illustrates a preferred embodiment of the method according to the invention.

FIG. 2 illustrates a fluidized bed furnace 1, to which material is charged via a line 2. The material, which comprises finely divided pyrrhotite, is passed from a pocket 3 via a line 4 to an agglomerating means 5, in which the material is rolled between smooth or surface knurled rolls and the formed agglomerates are optionally crushed.

Fludizing and roasting air is passed to the furnace 1 via a line 6. Roaster gases and finely divided roasted products entrained with said gases are removed via a line 7 and cooled in a waste heat boiler 8, from which the roaster gases are passed, via a line 9, to a cyclone 10, in which the major portion of the entrained finely divided roasted products are separated. The gas freed from the roasted products is passed, via a line 11, to an elctrofilter 12, in which it is freed from any remaining finely divided material. The gas is then removed, via a line 13, for example for manufacturing sulphuric acid or liquid sulphur dioxide. Separated finely divided roasted products are passed from the waste heat boiler B, via a line 14, from the cyclone 10, via a line 15, and from the electrofilter 12, via a line 16, back to the agglomerating means 5, optionally after having passed a mixing means (not shown). The obtained coarse roasted products are removed from the furnace 1 via an outlet 17.

What we claim is:

1. A process for forming a agglomerated, hardened substantially sulphur-free product when roasting fine grained pyrrhotitic material comprising a. agglomerating said pyrrhotitic material to a size distribution suited for fluidizing treatment;
b. controlling the moisture of the pyrrhotitic material to be sufficiently low to prevent the formed agglomerates decrepitating by steam pressure when subsequently being passed into a hot fluidized bed;
c. passing the agglomerated material into a fluidized bed furnace to be roasted and hardened at a temperature of between 700° and 1100°C. and
d. removing the hardened, substantially completely desulphurized iron oxide agglomerates from the bed in a hot condition.

2. A process according to claim 1, in which the fine grained roasted products entrained from the fluidized bed with the roaster gases are separated and returned to the agglomerating stage.

3. A process according to claim 2, in which the fine grained roasted products separated from the roaster gases in a hot condition are admixed to the sulphide material to be agglomerated.

4. A process when roasting according to claim 1, in which the roasting is effected at a temperature between 700° and 1100°C. while supplying a gas containing free oxygen in such quantities that the partial pressure of oxygen in the resulting roaster gases is maintained under a pressure temperature curve which in a coordinate system, where the ordinate expresses the oxygen partial pressure in the atmosphere as $\log_{10}P_{O_2}$ and the abscissa the temperature in °C. is drawn through the following points:

| $\log_{10}P_{O_2}$ | Temp. |
|---|---|
| −12.0 | 700 |
| −9.5 | 800 |
| −7.5 | 900 |
| −5.8 | 1000 |
| −5.0 | 1050 |

but not within the corresponding curve through the following points:

| $\log_{10}P_{O_2}$ | Temp. |
|---|---|
| −15.0 | 700 |
| −13.5 | 800 |
| −12.0 | 900 |
| −10.7 | 1000 |
| −10.0 | 1050 |

5. A process for forming an agglomerated, hardened, substantially sulfur-free product from fine grained, pyritic material comprising:

a. driving off thermally splittable sulfur from said pyritic material by partial roasting or other thermal treatment;
b. agglomerating the partially desulfurized material to a size distribution suited for fluidizing treatment;
c. controlling the moisture of the material to be sufficiently low to prevent the formed agglomerates decrepitating by steam pressure when subsequently being passed into a hot fluidized bed;
d. passing the agglomerated material into a fluidized bed furnace to be roasted and hardened at a temperature of between 700° and 1100°C. and
e. removing the hardened, substantially completely desulfurized iron oxide agglomerates from the bed in a hot condition.

6. A process according to claim 5, in which the fine grained roasted products entrained from the fluidized bed with the roaster gases are separated and returned to the agglomerating stage.

7. A process according to claim 6, in which the fine grained roasted products separated from the roasted gases in a hot condition are admixed to the sulphide material to be agglomerated.

8. A process when roasting according to claim 5, in which the roasting is effected at a temperature between 700° and 1100°C. while supplying a gas containing free oxygen in such quantities that the partial pressure of oxygen in the resulting roaster gases is maintained under a pressure temperature curve which in a coordinate system, where the ordinate expresses the oxygen partial pressure in the atmosphere as $\log_{10}P_{O_2}$ and the abscissa the temperature in °C. is drawn through the following points:

| $\log_{10}P_{O_2}$ | Temp. |
|---|---|
| − 12.0 | 700 |
| − 9.5 | 800 |
| − 7.5 | 900 |
| − 5.8 | 1000 |
| − 5.0 | 1050 |

but not within a corresponding curve through the following points:

| $\log_{10}P_{O_2}$ | Temp. |
|---|---|
| − 15.0 | 700 |
| − 13.5 | 800 |
| − 12.0 | 900 |
| − 10.7 | 1000 |
| − 10.0 | 1050. |

* * * * *